US006497480B1

(12) United States Patent
Wexler

(10) Patent No.: US 6,497,480 B1
(45) Date of Patent: Dec. 24, 2002

(54) INK JET PRINTING METHOD

(75) Inventor: Allan Wexler, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/954,779

(22) Filed: Sep. 18, 2001

(51) Int. Cl.[7] ..... B41J 2/01
(52) U.S. Cl. ..... 347/102; 347/105; 428/195
(58) Field of Search ..... 347/105; 428/195

(56) References Cited

U.S. PATENT DOCUMENTS 4,785,313 A * 11/1988 Higuma et al. ..... 347/105
4,832,984 A 5/1989 Hasegawa et al.
6,015,624 A * 1/2000 Williams ..... 428/500
6,103,042 A * 8/2000 Hatada et al. ..... 156/235
6,346,353 B1 * 2/2001 Wang et al. ..... 430/14

FOREIGN PATENT DOCUMENTS

EP 0 858 905 A1 8/1998

* cited by examiner

*Primary Examiner*—Hai Pham
*Assistant Examiner*—Ly T Tran
(74) *Attorney, Agent, or Firm*—Harold E. Cole

(57) ABSTRACT

An inkjet printing method with the steps of: I) providing an ink jet printer that is responsive to digital data signals; II) loading the printer with an ink jet recording element having a support having thereon in order: a) at least one porous, ink-retaining layer; and b) a fusible, porous ink-transporting layer having fusible, polymeric particles and a film-forming, hydrophobic binder; III) loading the printer with an ink jet ink composition; IV) printing on the image-receiving layer using the ink jet ink composition in response to the digital data signals; and V) fusing the fusible, porous ink-transporting layer to provide a continuous polymeric layer on the surface of the ink jet recording element.

19 Claims, No Drawings

INK JET PRINTING METHOD

CROSS REFERENCE TO RELATED APPLICATION

Reference is made to commonly assigned, co-pending U.S. patent application Ser. No. 09/955,549 by Wexler, filed of even date herewith, entitled Ink Jet Recording Element.

FIELD OF THE INVENTION

The present invention relates to a inkjet printing method using a porous ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof at least one ink-receiving layer. The ink-receiving layer is typically either a porous layer that imbibes the ink via capillary action, or a polymer layer that swells to absorb the ink. Swellable hydrophilic polymer layers take an undesirably long time to dry. Porous ink-receiving layers are usually composed of inorganic or organic particles bonded together by a binder. The amount of particles in this type of coating is often far above the critical particle volume concentration, which results in high porosity in the coating. During the ink jet printing process, ink droplets are rapidly absorbed into the coating through capillary action and the image is dry-to-touch right after it comes out of the printer. Therefore, porous coatings allow a fast "drying" of the ink and produces a smear-resistant image.

Ink jet prints, prepared by printing onto ink jet recording elements, are subject to environmental degradation. They are especially vulnerable to damage resulting from contact with water and atmospheric gases such as ozone. The damage resulting from the post imaging contact with water can take the form of water spots resulting from deglossing of the top coat, dye smearing due to unwanted dye diffusion, and even gross dissolution of the image recording layer. Ozone bleaches ink jet dyes resulting in loss of density. To overcome these deficiencies, ink jet prints are often laminated. However, lamination is expensive as it requires a separate roll of material.

U.S. Pat. Nos. 4,785,313 and 4,832,984 relate to an inkjet recording element comprising a support having thereon a fusible, ink-transporting layer and an ink-retaining layer, wherein the ink-retaining layer is non-porous. However, there is a problem with this element in that it has poor image quality.

EP 858, 905A1 relates to an ink jet recording element having a porous, outermost layer formed by heat sintering thermoplastic particles such as polyurethane which may contain a slight amount of a hydrophilic binder such as poly(vinyl alcohol). However, there is a problem with this element in that it has poor resistance to mechanical abrasion when it does not contain a hydrophilic binder, and poor water-resistance when it does contain a hydrophilic binder.

It is an object of this invention to provide an inkjet printing method using an ink jet recording element having a fusible protective uppermost layer and ink-retaining underlayer which can be printed with ink jet inks without bleed. It is another object of the invention to provide an ink jet printing method using a porous ink-transporting layer that has good mechanical integrity and is abrasion resistant. It is another object of the invention to provide an ink jet printing method using an ink jet recording element having a protective uppermost ink-transporting layer that is thermally fusible and thereby can be rendered water resistant. It is another object to provide an ink jet printing method using an ink jet recording element that can be thermally fused to provide high density of the printed image.

SUMMARY OF THE INVENTION

These and other objects are achieved in accordance with the invention which comprises an ink jet printing method comprising the steps of:

I) providing an ink jet printer that is responsive to digital data signals;

II) loading the printer with an ink jet recording element comprising a support having thereon in order:
   a) at least one porous, ink-retaining layer; and
   b) a fusible, porous ink-transporting layer comprising fusible, polymeric particles and a film-forming, hydrophobic binder;

III) loading the printer with an ink jet ink composition;

IV) printing on the image-receiving layer using the ink jet ink composition in response to the digital data signals; and V) fusing the fusible, porous ink-transporting layer to provide a continuous polymeric layer on the surface of the ink jet recording element.

By use of the ink jet printing method of the invention, a porous ink jet recording element is obtained that has good abrasion resistance, has good water-resistance and high print density.

DETAILED DESCRIPTION OF THE INVENTION

The fusible, polymeric particles employed in the invention may have any particle size provided they will form a porous layer. In a preferred embodiment of the invention, the particle size of the fusible, polymeric particles may range from about 0.5 to 10 $\mu$m. The particle may be formed from any polymer which is fusible, i.e., capable of being converted from discrete particles into a continuous layer through the application of heat and/or pressure. In a preferred embodiment of the invention, the fusible, polymeric particle comprises a condensation polymer, a styrenic polymer, a vinyl polymer, an ethylene-vinyl chloride copolymer, a polyacrylate, poly(vinyl acetate), poly (vinylidene chloride), a vinyl acetate-vinyl chloride copolymer. In still another preferred embodiment, the condensation polymer may be a polyester or polyurethane.

The film-forming, hydrophobic binder useful in the invention can be any film-forming hydrophobic polymer capable of being dispersed in water. In a preferred embodiment of the invention, the hydrophobic binder is an aqueous dispersion of an acrylic polymer or a polyurethane.

The particle-to-binder ratio of the particles and binder employed in the ink-transporting layer can range between about 98:2 and 60:40, preferably between about 95:5 and 80:20. In general, a layer having particle-to-binder ratios above the range stated will usually not have sufficient cohesive strength; and a layer having particle-to-binder ratios below the range stated will usually not be sufficiently porous to provide good image quality.

In a preferred embodiment of the invention, the ratio of the mean volume weighted size of the dispersed film forming hydrophobic polymeric binder particles to the fusible, polymeric particles is preferably 0.15 to 1, and more preferably greater than 0.41 to 1, as determined by a Horiba LA-920 Laser Scattering Particle Size Distribution Analyzer (Horiba Instruments, Inc.). While not being bound by any theory, it is believed that if the ratio is below the lower limit stated, the binder particles pass through the interparticle voids between the larger fusible particles, and deposit at the interface with the ink-retaining layer. The resultant structure blocks ink flow into the ink-retaining layer, resulting in undesirable bleed. The interparticle voids are taken to be the radius in the plane of contact of the interstice, r, formed by three spheres of radius, R. In a close packed array, r=0.15R, and in the more open array of square packed spheres r=0.41R.

The ink-retaining layer can be any porous structure, but it is preferred that the mean pore radius is smaller than the uppermost ink-transporting layer. Thus, if the ink-retaining layer is composed of particles and binder, the particles will be significantly smaller than the fusible, polymeric particles in the upper ink-transporting layer, thereby assuring a correct pore-size hierarchy.

In general, the ink-retaining layer or layers will have a thickness of about 1 $\mu$m to about 50 $\mu$m, and the top ink-transporting layer will usually have a thickness of about 2 $\mu$m to about 50 $\mu$m. In a preferred embodiment, the ink-retaining layer is present in an amount from about 1 g/m$^2$ to about 50 g/m$^2$, preferably from about 5.0 g/m$^2$ to about 30 g/m$^2$.

In a preferred embodiment of the invention, the ink-retaining layer is a continuous, co-extensive porous layer which contains organic or inorganic particles. Examples of organic particles which may be used include core/shell particles such as those disclosed in U.S. Ser. No. 09/609,969 of Kapusniak et al., filed Jun. 30, 2000, and homogeneous particles such as those disclosed in U.S. Ser. No. 09/608,466 of Kapusniak et al., filed Jun. 30, 2000, the disclosures of which are hereby incorporated by reference. Examples of organic particles which may be used include acrylic resins, styrenic resins, cellulose derivatives, polyvinyl resins, ethylene-allyl copolymers and polycondensation polymers such as polyesters.

Examples of inorganic particles which may be used in the ink-retaining layer employed in the invention include silica, alumina, titanium dioxide, clay, calcium carbonate, barium sulfate, or zinc oxide.

In a preferred embodiment of the invention, the porous ink-retaining layer comprises from about 20% to about 100% of particles and from about 0% to about 80% of a polymeric binder, preferably from about 80% to about 95% of particles and from about 20% to about 5% of a polymeric binder. The polymeric binder may be a hydrophilic polymer such as poly(vinyl alcohol), poly(vinyl pyrrolidone), gelatin, cellulose ethers, poly(oxazolines), poly(vinylacetamides), partially hydrolyzed poly(vinyl acetate/vinyl alcohol), poly (acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. Preferably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin.

Suitable porous materials for an ink-retaining layer include, for example, silica or alumina in a polymeric binder. In a preferred embodiment, the ink-retaining layer is porous fumed alumina in a crosslinked poly(vinyl alcohol) binder.

In order to impart mechanical durability to an inkjet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate and the like may be used. Preferably, the crosslinker is an aldehyde, an acetal or a ketal, such as 2,3-dihydroxy-1,4-dioxane.

The porous ink-retaining layer can also comprise an open-pore polyolefin, an open-pore polyester or an open pore membrane. An open pore membrane can be formed in accordance with the known technique of phase inversion. Examples of a porous ink-receiving layer comprising an open-pore membrane are disclosed in U.S. Ser. No. 09/626,752 and U.S. Ser. No. 09/626,883, both of Landry-Coltrain et al., filed Jul. 27, 2000.

In another preferred embodiment of the invention, two porous, ink-retaining layers are present in the ink jet recording element employed in the invention. In this embodiment, the uppermost layer is substantially the same as the lower layer, but at a thickness of only 1% to 20% of the thickness of the lower layer, and also contains from about 1–20% by weight of a mordant, such as a cationic latex mordant.

The two porous, ink-retaining layers can be coated simultaneously or sequentially by any of the known coating techniques as noted below. The dye image is then concentrated at the thin uppermost ink-retaining layer containing a mordant, and thereby enhances print density.

The support used in the ink jet recording element employed in the invention may be opaque, translucent, or transparent. There may be used, for example, plain papers, resin-coated papers, various plastics including a polyester resin such as poly(ethylene terephthalate), poly(ethylene naphthalate) and poly(ester diacetate), a polycarbonate resin, a fluorine resin such as poly(tetra-fluoro ethylene), metal foil, vinyl, fabric, laminated or coextruded supports, various glass materials, and the like. In a preferred embodiment, the support is a resin-coated paper. The thickness of the support employed in the invention can be from about 12 to about 500 $\mu$m, preferably from about 75 to about 300 $\mu$m.

If desired, in order to improve the adhesion of the base layer to the support, the surface of the support may be corona-discharge-treated prior to applying the base layer or solvent-absorbing layer to the support.

Since the image recording element may come in contact with other image recording articles or the drive or transport mechanisms of image recording devices, additives such as surfactants, lubricants, UV-absorbing agents, matte particles and the like may be added to the element to the extent that they do not degrade the properties of interest.

The layers described above, including the base layer and the top layer, may be coated by conventional coating means onto a support material commonly used in this art. Coating methods may include, but are not limited to, wound wire rod coating, slot coating, slide hopper coating, gravure, curtain coating and the like. Some of these methods allow for simultaneous coatings of both layers, which is preferred from a manufacturing economic perspective.

After printing on the element employed in the invention, the fusible, porous ink-transporting layer is heat and/or pressure fused to form an overcoat layer on the surface. Fusing is preferably accomplished by contacting the surface of the element with a heat fusing member, such as a fusing roller or fusing belt. Thus, for example, fusing can be accomplished by passing the element through a pair of heated rollers, heated to a temperature of about 60° C. to about 160° C., using a pressure of 5 to about 15 MPa at a transport rate of about 0.005 m/sec to about 0.5 m/sec.

Ink jet inks used to image the recording elements employed in the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Example 1

Synthesis of Polyurethane Polymer

In a 2 liter resin flask equipped with thermometer, stirrer, water condenser and vacuum outlet, 123 g (0.041 mole) Polyester polyol, Tone® 0260, (Union Carbide Corp.), Mw 3000, was melted and dewatered under vacuum at 90° C. The vacuum was released and at 40° C. there was then added 10.20 g (0.076 mole) 2,2-Bis(hydroxymethyl)propionic acid, 128.76 g (0.383 mole) Hexafluorobisphenol A, 75 g of Reagent grade Ethyl Acetate, and 20 drops of Dibutyltin Dilaurate (catalyst). The temperature was adjusted to 80° C. and the contents stirred for 30 minutes. The temperature was lowered to 70° C. and while stirring, 111.20 g (0.50 mole) of isophrone diisocyanate and 10 g ethyl acetate were added. The temperature was raised to 80° C. and reaction stirred at temperature until completion which gave, upon cooling, a 60.6 weight percent solids solution. The solution was used to prepare the polyurethane particles P1 described below.

Preparation of Polyurethane Particles—P1

To 194.8 g of the above 60.6% weight percent solids polyurethane dissolved in ethyl acetate described above was added 172.0 g of ethyl acetate and 4.0 g of triethanolamine. A separate aqueous composition was prepared by mixing 26.8 g of ethyl acetate and 1202.4 g of deionized water. The organic composition was added slowly to the aqueous composition using a low shear propeller mixing device. The resulting oil-in-water emulsion was then subjected to a high shear Brinkman rotor-stator mixer for 5 minutes at 5000 rpm. The ethyl acetate was removed by rotary evaporation under vacuum at 68° C. and the particles were concentrated to afford a 30% solids dispersion of 2 μm particles.

Preparation of Polystyrene Particles—P2

To 333 g styrene was added 10 g 2,2'-azobis(2,4-dimethylvaleronitrile), Vazo 52® (DuPont Corp.), and stirred until the Vazo 52® dissolved. Separately, an aqueous phase was prepared by adding to 1000 g of distilled water, 10.43 g potassium hydrogen phthalate, 4 g 0.1N HCl, 7.2 g poly(adipic acid-co-methylaminoethanol) and 91.5 g of Ludox TM® colloidal silica, and stirring for 15 minutes. The organic phase was then added to the stirred (marine prop agitator) aqueous phase and stirred for 15 minutes. The resultant dispersion was passed through a Gaulin homogenizer twice at 20.7 MPa and then heated at 54° C. for sixteen hours. There was thereby obtained a narrowly distributed population of 2 μm polystyrene particles.

Preparation of Coating Solutions for Ink-transporting Upper Layer

Coating solution S1 was prepared by adding to the P1 particles the hydrophobic binder, B1, Witcobond®W320, an aqueous dispersion of 1.9 polyurethane particles Tg=−12° C. The coating solution at 20% solids comprised 90 parts by weight P1 particle solids and 10 parts by weight binder solids.

Coating solution S2 was prepared by adding to the P2 particles the same hydrophobic binder. The solution at 20% solids comprised 85 parts P2 particle solids and 15 parts binder solids.

Preparation of Porous Ink-Retaining Lower Layers

A polyethylene resin-coated paper support was corona discharge treated. The support was then hopper coated and force air dried at 60° C. to provide the following ink-retaining layers:

Layer L1—a 38 μm layer comprising 87% fumed alumina, 9% poly(vinyl alcohol), and 4% dihydroxydioxane crosslinking agent.

Layer L2—a two layer structure comprising L1 and coated simultaneously on L1 a 2 μm layer comprising 87% fumed alumina, 8% 100 nm colloidal latex dispersion of divinylbenzene-co-N-vinylbenzyl-N,N,N-trimethylammonium chloride, 6% poly(vinyl alcohol), and 1% Zonyl®FSN surfactant (Dupont Corp.).

Preparation of Control Non-Porous Hydrophilic Ink-Retaining Layers

Hydrophilic Layer L3—an aqueous solution comprising 6.7% gelatin, and 1.2% poly(vinyl pyrrolidone), K90 (International Specialty Products Co.) was hopper coated to provide an ink-retaining layer of 8.6 g/m$^2$.

The following control layers were rod coated:

Hydrophilic Layer L4—an aqueous solution comprising 10% poly(vinyl pyrrolidone), K90 (International Specialty Products Co.) was rod coated and air dried to provide a base layer of 8.0 g/m$^2$;

Hydrophilic Layer L5—a layer comprising polyvinyl alcohol at 8.0 g/m$^2$ was prepared in like fashion.

Element 1 of the Invention

The porous ink-transporting layer was prepared by separately coating solutions as shown in Table 1 over the porous ink-retaining layers as shown in Table 1 using a wire wound rod, calibrated to give a wet laydown of 40 μm and air dried.

Control Elements C-1 through C-4

These elements were prepared the same as Element 1 except using the solutions and ink-retaining layers as shown in Table 1.

Control Elements C-5 through C-8

These elements were layers L2 through L5 without the ink-transporting layer.

Printing

A bleed test target was printed on the elements and control with a Hewlett-Packard Photosmart® printer. The target design had seven adjacent 9 mm by 48 mm rectangular bars, each bar was one of the primary or secondary subtractive color i.e. C,M,Y,R,G,B,K, and in each bar was embedded six 7 mm squares of the other colors. So, for example, the Cyan bar had embedded squares of M,Y,R,G,B,K.

Testing

The printed elements were then examined for bleed with the following evaluation standards:

5: No change in the shape of the embedded squares with sharp edges of the squares maintained 3: The square pattern was slightly rounded with smooth edges 1: Major spreading and deformation of the rectangular pattern with ragged edges.

An evaluation of 5 or 3 is necessary for good image quality. The following results were obtained:

TABLE 1

| Element | Solution | Ink-Retaining Layer | Bleed |
|---|---|---|---|
| 1 | S1 | L1 | 5 |
| 2 | S1 | L2 | 5 |
| 3 | S2 | L2 | 5 |
| Control 1 | S1 | L3 | 1 |
| Control 2 | S1 | L4 | 1 |
| Control 3 | S1 | L5 | 1 |
| Control 4 | S2 | L3 | 1 |
| Control 5 | — | L2 | 5 |
| Control 6 | — | L3 | 5 |
| Control 7 | — | L4 | 5 |
| Control 8 | — | L5 | 5 |

The above results show that the elements employed in the invention having a fusible, porous ink-transporting uppermost layer and porous ink-retaining bottom layers have excellent bleed performance, whereas the control elements having the same ink-transporting layer over a non-porous hydrophilic ink-retaining layer have poor bleed performance which is significantly worse than that of the hydrophilic layer alone.

Example 2

Preparation of Urethane Particles Employed in the Invention

Particle P3

In a 2 liter resin flask equipped with thermometer, stirrer, water condenser and a vacuum outlet, 107.5 g (0.125 mole) polycarbonate polyol PC1733, Mw=860, (Stahl Co.) was melted and dewatered under vacuum at 100° C. The vacuum was released and then at 40° C., 10.2 g (0.076 mole) dimethylol propionic acid, 100.52 g (0.299 mole) bisphenol AF, and 75 g methyl ethyl ketone were added. Then 20 drops dibutyltin dilaurate (catalyst) was added while stirring. The temperature was adjusted to 75° C. and maintained until a homogeneous reaction mixture was obtained. Slowly, 111.2 g (0.50 mole) isophorone diisocyanate was added followed by 10 g methyl ethyl ketone. The temperature was raised to 85° C. and maintained until the isocyanate functionality was reduced to substantially nil. While stirring, a stoichiometric amount of potassium hydroxide based on dimethylol propionic acid was added, and maintained for 5 minutes. An amount of water about 5 times the amount of methyl ethyl ketone was added with rapid stirring to form a milky white aqueous dispersion. The mean particle size was 6.1 $\mu$m as determined using a Horiba LA-920 Particle Size Analyzer.

Binders

The following binders were employed in this Example for Elements of the Invention:

Hydrophobic Binder B1 Witcobond® W320 an aqueous dispersion of 1.9 micron polyurethane particles Tg=−12° C. from Uniroyal Chemical Co.

Hydrophobic Binder B2 Witcobond® W507 an aqueous dispersion of 1.9 micron polyurethane particles Tg=−30° C. from Uniroyal Chemical Co.

Hydrophobic Binder B3 Witcobond® W290H an aqueous dispersion of 1.9 micron polyurethane particles Tg=−44° C. from Uniroyal Chemical Co.

The following binders were employed in this Example for Control Elements:

Hydrophilic Binder B4—Methyl Cellulose A4M a water-soluble polymer from Dow Chemical Co.

Hydrophilic Binder B5—A water soluble polyvinyl alcohol from Nippon Gohsei Co.

Hydrophilic Binder B6—Limed ossein gelatin.

Elements 4–7 of the Invention

The porous ink-transporting layer was prepared by coating an 8.1% solids dispersion comprised of 85 parts particles P3 and 15 parts hydrophobic binder B1. The dispersion was coated with a 40 $\mu$m wire wound rod over the porous ink-retaining layer L2 described in Example 1 to form Element 4. Elements 5–7 were similarly prepared from 20% solids dispersions comprised of 90 parts particles P1 and 10 parts hydrophobic binder in the combinations given in the table below.

Control Elements C9–C11

These elements were prepared by coating a 10% solids dispersion comprised of 95 parts particles P3 and 10 parts hydrophilic binder B4 on the porous ink-retaining layer L2. Controls 10 and 11 were similarly prepared and coated from 20% solids dispersions comprised of 90 parts particles P1 and 10 parts hydrophilic binders in the combinations given in the table below.

Printing

A test target comprised was printed with a Hewlett-Packard Photosmart® printer. The target consisted of seven sets of four 1 $cm^2$ color patches, a set in each of the primary and secondary colors and black. Each patch was printed at a single density, the set ranging from 25% to 100% density in equal steps.

Fusing and Testing

The printed elements and controls were fused in a heated nip at 150° C. and 4.2 $kg/cm^2$ against a sol-gel coated polyimide belt at 63.5 cm/min. A water drop was placed on each color patch of the fused print for 30 minutes and then blotted. Waterfastness was judged by the transfer of dye to the blotter and density loss in the blotted color patch on the following scale:

5—no dye transfer to blotter and no density loss observable in the color patch.

1—heavy dye transfer to blotter and significant density loss in blotted color patch.

TABLE 2

| Element | Particles | Binder | Water Resistance |
|---|---|---|---|
| 4 | P3 | B1 | 5 |
| 5 | P1 | B1 | 5 |
| 6 | P1 | B2 | 5 |
| 7 | P1 | B3 | 5 |
| Control 9 | P3 | B4 | 1 |
| Control 10 | P1 | B5 | 1 |
| Control 11 | P1 | B6 | 1 |

The above results show that the elements 4–7 employed in the invention with a hydrophobic binder in the porous ink-transporter layer had excellent water resistance whereas the controls with a hydrophilic binder in the ink-transporting layer have poor water resistance.

Example 3

The following particles were used in this Example:

Particles P4—prepared substantially as per P3 but neutralized with a stoichiometric amount of triethanol amine and dispersed using Aerosol®OT surfactant affording a particle size 3.8 microns.

Particles P5—prepared substantially as per P1 but with a particle size of 2.4 microns.

Particles P6—prepared substantially as per P3 but neutralized with one half the stoichiometric amount of KOH affording a particle size of 30 microns.

In addition to Binder B1, B2 and B3 described above, the following additional binders were used in this Example:

Binder B7—Epocros® 2010 a commercially available acrylic latex obtained from Esprix Technologies mean particle size 0.15 μm Binder B8—Epocros®2020 a commercially available acrylic latex obtained from Esprix Technologies mean particle size 0.10 μm Binder B9—Witcobond®234 an aqueous dispersion of 0.10 micron polyurethane particles Tg=−28° C.

Elements 8–13 of the Invention

Aqueous 20% solids dispersions were prepared from combinations of the above particles and binders at 90 parts polyurethane particles and 10 parts binder particles in combinations whose binder to particle size ratio was at least 0.15 and coated with a 40 μm wire wound rod over the porous ink-retaining layer L2 from Example 1 to form elements of the invention 8–13, as shown in Table 3.

Controls C12–C18

Controls C12–C18 were prepared similar to Elements 8–13 except combinations of particles and binder were chosen whose size ratio was less than 0.15. Control 1 had no binder and Control 18 was Canon "HyperPhoto" media, a commercially available product with a sintered ink-transporting layer, as shown in Table 3.

Testing

Abrasion resistance of the unfused coatings was tested by contacting the coatings with a 2.5 by 8.0 cm strip of acid free 29.5 kg card stock black paper from Fiskars Inc., and applying a 4.4 N force to the latter third of the strip while uniformly transporting it across the coating. The test was evaluated by noting the density of white powder transferred to the black paper strip according to the following criteria:

5—No transfer

3—Light transfer

1—Heavy transfer

A rating less than 3 is unacceptable for abrasion resistance. A bleed test target was printed and the elements and controls were then fused as described in Example 2. The bleed target was evaluated as described in Example 1.

TABLE 3

| Element | Binder Size (μm) | Particle Size (μm) | B/P Size Ratio | Bleed | Abrasion |
|---|---|---|---|---|---|
| 8 | B1 (1.9) | P1 (3.8) | 0.5 | 5 | 5 |
| 9 | B2 (1.0) | P1 (3.8) | 0.26 | 3 | 5 |
| 10 | B3 (1.1) | P1 (3.8) | 0.29 | 3 | 5 |
| 11 | B1 (1.9) | P2 (2.4) | 0.79 | 5 | 5 |
| 12 | B2 (1.0) | P2 (2.4) | 0.41 | 5 | 5 |
| 13 | B3 (1.1) | P2 (2.4) | 0.49 | 5 | 5 |
| Control 12 | — | P1 (3.8) | 0.0 | 5 | 1 |
| Control 13 | B7 (0.15) | P1 (3.8) | 0.04 | 1 | — |
| Control 14 | B8 (0.10) | P1 (3.8) | 0.03 | 1 | — |
| Control 15 | B9 (0.10) | P1 (3.8) | 0.03 | 1 | — |

TABLE 3-continued

| Element | Binder Size (μm) | Particle Size (μm) | B/P Size Ratio | Bleed | Abrasion |
|---|---|---|---|---|---|
| Control 16 | B9 (0.10) | P2 (2.4) | 0.04 | 1 | — |
| Control 17 | B1 (1.9) | P6 (30) | 0.06 | 1 | — |
| Control 18 | — | (0.5) | 0.0 | 5 | 3 |

The above results show that Elements 8–13 employed in the exhibited little or no bleed with good mechanical integrity whereas the control elements were deficient in abrasion resistance.

Example 4

Particles

Urethane particles P1 from Example 1 were used.

Binders

Hydrophobic binders B1–B13 from Example 2 were used.

Ink-Retaining Layers

The ink-retaining layers L1 and L2 from Example 1 were used.

Elements 14–16 of the Invention

The ink-transporting layer was prepared by coating dispersions formed from combining urethane particles P1 at 90 parts by weight with each of the binders B1–B3 at 10 parts by weight to give 20% solids dispersions. The dispersions formed with binders B1–B3 were coated with a 40 μm wire-wound rod on porous ink-retaining layer L-2.

Controls 19–21

The controls were prepared similar to Elements 14–16 except that the dispersions formed by combining the particles with binders B1–B3 were coated on the porous ink-retaining layer L1.

Printing

A test target comprised was printed with a Hewlett-Packard Photosmart® printer. The target consisted of 3 $cm^2$ color patches at 100% density in each of the primary and secondary colors and black.

Fusing and Testing

The printed elements and controls were fused as in Example 2. The densities of the printed patches were then read with the following results.

TABLE 4

| Element | Blue | Cyan | Magenta | Yellow | Green | Red | Black |
|---|---|---|---|---|---|---|---|
| 14 | 2.08 | 2.05 | 1.86 | 1.79 | 1.21 | 0.72 | 2.0 |
| 15 | 2.1 | 1.75 | 1.9 | 1.77 | 1.23 | 0.72 | 2.06 |
| 16 | 2.00 | 1.98 | 1.83 | 1.72 | 1.22 | 0.71 | 1.99 |
| Control 19 | 1.85 | 2.07 | 1.68 | 1.65 | 1.22 | 0.73 | 1.88 |
| Control 20 | 1.84 | 2.04 | 1.69 | 1.65 | 1.19 | 0.72 | 1.88 |
| Control 21 | 1.84 | 1.96 | 1.68 | 1.64 | 1.19 | 0.72 | 1.88 |

The above results show that Elements 14–16 employed in the invention with two porous ink-retaining layers and whose thin upper layer contains a mordant having significantly higher magenta, yellow, blue and black densities than the control elements.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet printing method comprising the steps of:

I) providing an ink jet printer that is responsive to digital data signals;

II) loading said printer with an ink jet recording element comprising a support having thereon in order:

a) at least one porous, ink-retaining layer, said porous, ink-retaining layer comprising a polymeric open-pore membrane or comprising from about 20% to about 100% of particles and from about 0% to about 80% of a polymeric binder; and b) a fusible, porous ink-transporting layer comprising fusible, polymeric particles and a film-forming, hydrophobic binder;

III) loading said printer with an ink jet ink composition;

IV) printing on said ink jet recording element using said inkjet ink composition in response to said digital data signals; and V) fusing said fusible, porous ink-transporting layer to provide a continuous polymeric layer on the surface of said ink jet recording element.

2. The method of claim 1 wherein said ink-transporting layer is prepared by coating on said ink-retaining layer an aqueous dispersion of said fusible, polymeric particles and particles of said film-forming, hydrophobic binder, followed by drying.

3. The method of claim 2 wherein the size ratio of the hydrophobic binder particles to said fusible, polymeric particles is at least about 0.15 and the mean pore radius of said ink-transporting layer being greater than that of the ink-retaining layer.

4. The method of claim 1 wherein the particle size of said fusible, polymeric particles is from about 0.5 to about 10 $\mu$m.

5. The method of claim 1 wherein the particle-to-binder ratio of the ink-transporting layer is between about 95:5 and 60:40.

6. The method of claim 1 wherein said porous ink-retaining layer comprises from about 50% to about 95% of particles and from about 50% to about 5% of a polymeric binder.

7. The element of claim 1 wherein said particles in said porous ink-retaining layer comprise silica, alumina, titanium dioxide, clay, calcium carbonate, barium sulfate or zinc oxide.

8. The element of claim 1 wherein said polymeric binder in said porous ink-retaining layer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof, or gelatin.

9. The method of claim 1 wherein said porous, ink-retaining layer contains organic particles.

10. The method of claim 1 wherein said ink-retaining layer comprises a mixture of fumed alumina and crosslinked poly(vinyl alcohol).

11. The method of claim 1 wherein said ink-transporting layer has a thickness of about 1 $\mu$m to about 25 $\mu$m and said ink-retaining layer has a thickness of about 2 $\mu$m to about 50 $\mu$m.

12. The method of claim 1 wherein said support is resin-coated paper.

13. The method of claim 1 wherein said fusible, polymeric particles comprises a condensation polymer, a styrenic polymer, a vinyl polymer, an ethylene-vinyl chloride copolymer, a polyacrylate, poly(vinyl acetate), poly (vinylidene chloride), a vinyl acetate-vinyl chloride copolymer, a polyester, or a polyurethane.

14. The method of claim 1 wherein said hydrophobic binder comprises a polyurethane.

15. The method of claim 1 wherein said hydrophobic binder comprises an acrylic polymer.

16. The method of claim 1 wherein said ink-retaining layer comprises a multiple layer structure wherein the outermost layer is thinner than the undermost layer(s).

17. The method of claim 16 wherein said outermost layer contains a mordant.

18. The method of claim 1 wherein said fusible, polymeric particles are fused by the application of heat/or pressure.

19. The element of claim 1 wherein the mean pore radius of said ink-transporting layer is greater than that of said ink-retaining layer.

* * * * *